US009452504B2

(12) United States Patent
Chuang

(10) Patent No.: US 9,452,504 B2
(45) Date of Patent: Sep. 27, 2016

(54) DIGITAL PANEL OF BELT SANDER

(71) Applicant: Bor-Yann Chuang, Taichung (TW)

(72) Inventor: Bor-Yann Chuang, Taichung (TW)

( * ) Notice: Subject to any disclaimer, the term of this patent is extended or adjusted under 35 U.S.C. 154(b) by 91 days.

(21) Appl. No.: 14/622,624

(22) Filed: Feb. 13, 2015

(65) Prior Publication Data

US 2016/0236315 A1 Aug. 18, 2016

(51) Int. Cl.

| | |
|---|---|
| ***B24B 49/12*** | (2006.01) |
| ***B24B 49/10*** | (2006.01) |
| ***B24B 21/00*** | (2006.01) |
| ***B24B 55/00*** | (2006.01) |
| ***B24B 49/00*** | (2012.01) |

(52) U.S. Cl.
CPC ..... *B24B 21/00* (2013.01); *B24B 49/006* (2013.01); *B24B 55/00* (2013.01)

(58) Field of Classification Search
CPC ..... B24B 49/10; B24B 49/12; B24B 49/00; B24B 51/00
USPC ..... 451/300, 5, 8, 9, 10, 6
See application file for complete search history.

(56) References Cited

U.S. PATENT DOCUMENTS

| | | | | |
|---|---|---|---|---|
| 3,271,909 | A * | 9/1966 | Rutt | B24B 21/12 451/1 |
| 3,857,200 | A * | 12/1974 | Hill | B24B 49/18 451/56 |
| 3,867,794 | A * | 2/1975 | Robillard | B24B 49/10 451/21 |
| 4,262,455 | A * | 4/1981 | Rettew | B24B 21/18 451/24 |
| 4,989,376 | A * | 2/1991 | Armond | B23Q 5/26 451/11 |
| 5,582,539 | A * | 12/1996 | Wang | B24B 47/20 451/188 |
| 5,720,648 | A * | 2/1998 | Green | B24B 7/28 451/178 |
| 6,899,606 | B2 * | 5/2005 | Liao | B24B 47/20 198/813 |

* cited by examiner

*Primary Examiner* — Robert Rose
(74) *Attorney, Agent, or Firm* — Ming Chow; Sinorica, LLC

(57) ABSTRACT

A digital panel of a belt sander includes a control module. The control module is electrically connected with a conveyer motor and an abrasive belt wheel motor of the belt sander. The control module is connected with a detection module. The control module is further connected with a digital display module and an operation module. Thereby, the operation module controls the conveyer motor and the abrasive belt wheel motor of the belt sander, and detects the running state of the conveyer motor and the abrasive belt wheel motor through the detection module, and displays the running data of the conveyer motor and the abrasive belt wheel motor through the digital display module for the belt sander to be digitalized.

6 Claims, 6 Drawing Sheets

DIGITAL PANEL OF BELT SANDER

BACKGROUND OF THE INVENTION

1. Field of the Invention

The present invention relates to a belt sander, and more particularly to a digital panel of a belt sander.

2. Description of the Prior Art

A conventional belt sander comprises an immovable chassis and a movable workbench which can be adjusted up and down. In order to know the displacement distance of the workbench relative to the chassis, the chassis is provided with a dial indicator and the workbench is provided with an indicator relative to the dial indicator. The indicator is moved on the dial indicator according to the displacement distance of the workbench relative to the chassis, providing a scale indication effect.

However, the displacement distance of the workbench relative to the chassis is limited. Therefore, the displacement distance of the workbench relative to the chassis corresponds to the relative movement distance of the indicator on the dial indicator. The movement distance is very small. When the user reads the scale, due to the small interval between the scales, he/she cannot see the scale clearly. It is not easy to read the scale correctly. The user often knows an approximate value by the naked eye. It is not convenient for use. The measurement may be incorrect, so the processing precision cannot be improved, resulting in bad quality. Accordingly, the inventor of the present invention has devoted himself based on his many years of practical experiences to solve these problems.

SUMMARY OF THE INVENTION

The primary object of the present invention is to provide a digital panel of a belt sander to digitalize the belt sander for displaying the operation information and running state clearly so as to enhance the convenience of use, the processing precision, and processing quality.

In order to achieve the aforesaid object, the digital panel is disposed on the belt sander. The belt sander comprises a main body. The main body is transversely provided with a conveyer assembly and an abrasive belt wheel assembly. The conveyer assembly comprises a conveyer motor. The abrasive belt wheel assembly comprises an abrasive belt wheel motor and an adjustment member. The conveyer motor and the abrasive belt wheel motor are electrically connected with a power source, respectively. The digital panel of the belt sander comprises a control module, a detection module, a digital display module, and an operation module. The control module comprises a motor drive member, a conveyer motor control member, and an adjustment unit. The motor drive member is electrically connected with the conveyer motor and the abrasive belt wheel motor, respectively. The conveyer motor control member is electrically connected with the conveyer belt motor. The adjustment member is longitudinally disposed on the main body and coupled with the abrasive belt wheel assembly. The abrasive belt wheel assembly is adjustable by the adjustment member to move longitudinally. The detection module is electrically connected with the control module. The detection module comprises a conveyer rotation speed detection member and an abrasive belt wheel motor position detection member. The conveyer rotation speed detection member is disposed at the position where an output shaft of the conveyer motor is located. The abrasive belt wheel motor position detection member is disposed at the position where the adjustment member is located. The digital display module comprises a power display unit, a conveyer motor rotation speed display unit, an abrasive belt wheel assembly longitudinal position display unit, and a current load display unit. The power display unit is electrically connected with the power source for showing the power to be turned on/off. The conveyer motor rotation speed display unit is electrically connected with the conveyer rotation speed detection member. The abrasive belt wheel assembly longitudinal position display unit is electrically connected with the abrasive belt wheel motor position detection member. The current load display unit is electrically connected with the power source. The operation module comprises a power switch module, an abrasive belt wheel motor switch module, a conveyer motor switch module, and an emergent stop module. The power switch module is electrically connected with the power source. The abrasive belt wheel motor switch module is electrically connected with the abrasive belt wheel motor. The conveyer motor switch module is electrically connected with the conveyer motor. The emergent stop module is electrically connected with the control module.

Thereby, the operation module controls the conveyer motor and the abrasive belt wheel motor of the belt sander, and detects the running state of the conveyer motor and the abrasive belt wheel motor through the detection module, and displays the running data of the conveyer motor and the abrasive belt wheel motor through the digital display module for the belt sander to be digitalized.

DETAILED DESCRIPTION OF THE PREFERRED EMBODIMENTS

Embodiments of the present invention will now be described, by way of example only, with reference to the accompanying drawings.

Figure 1:
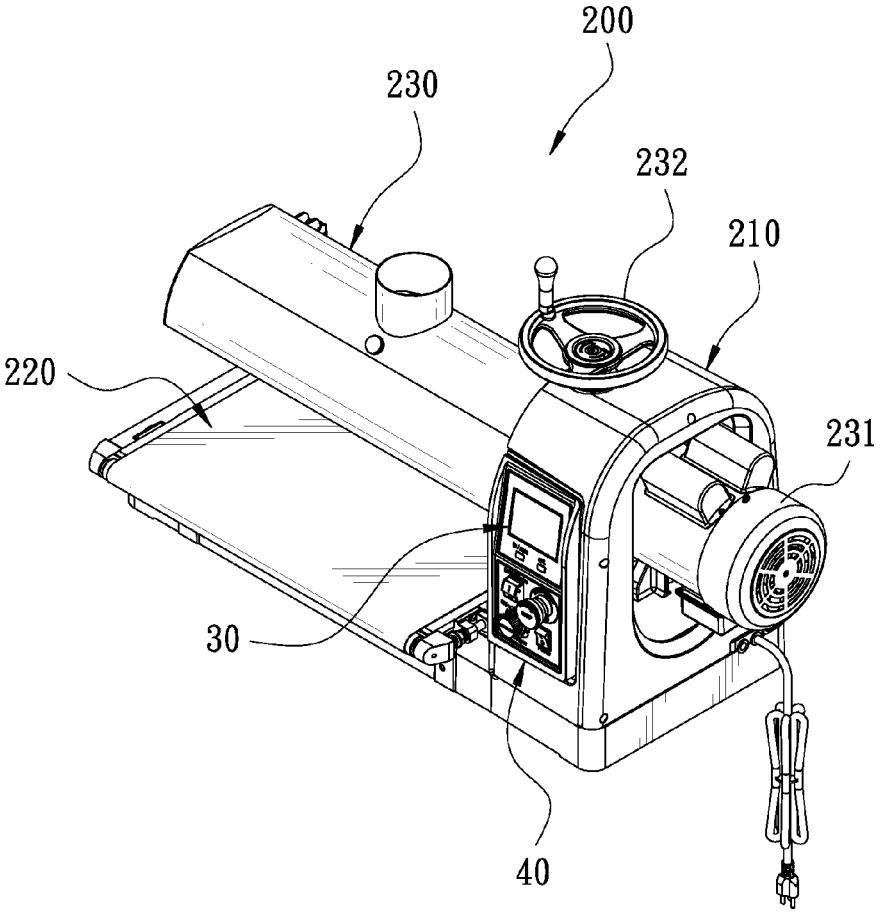
FIG. 1 is a perspective view of the present invention.
Figure 2:
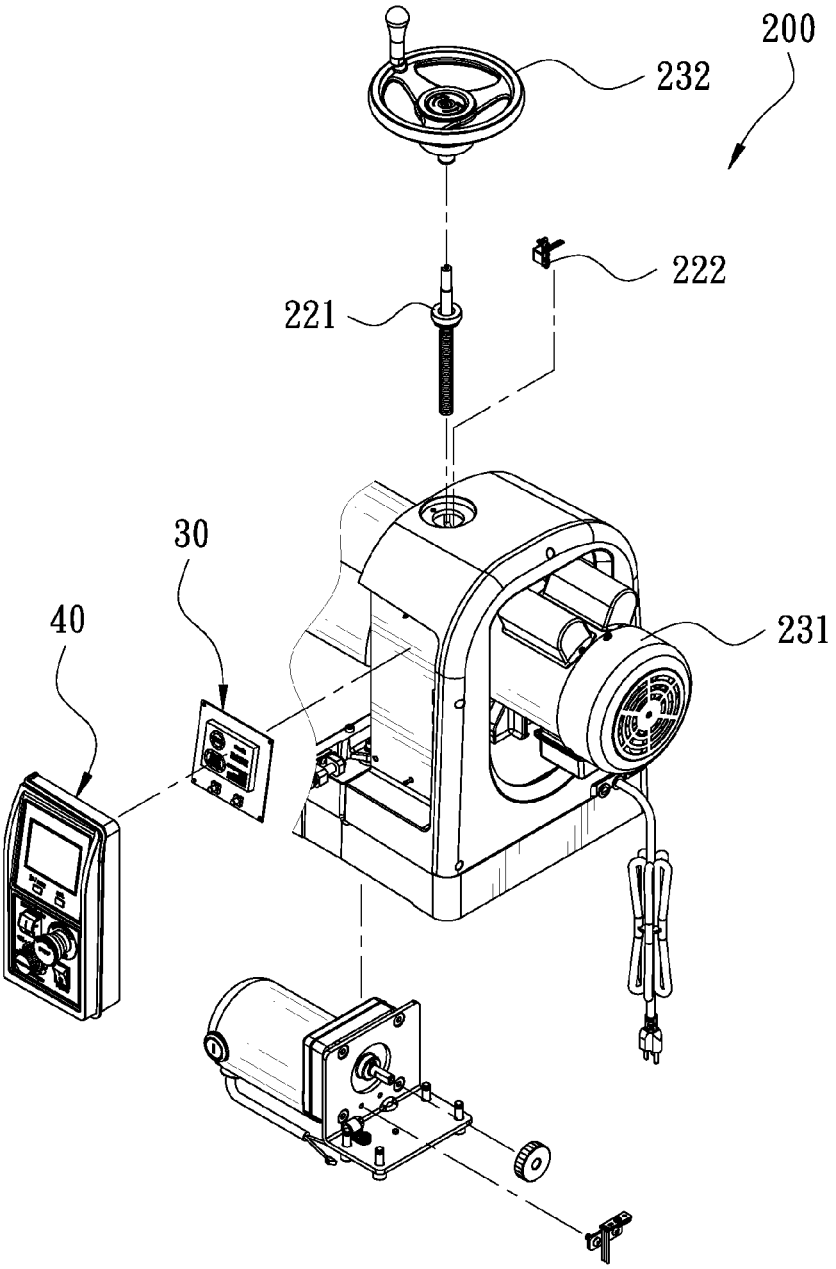
FIG. 2 is an exploded view of the present invention.
Figure 3:
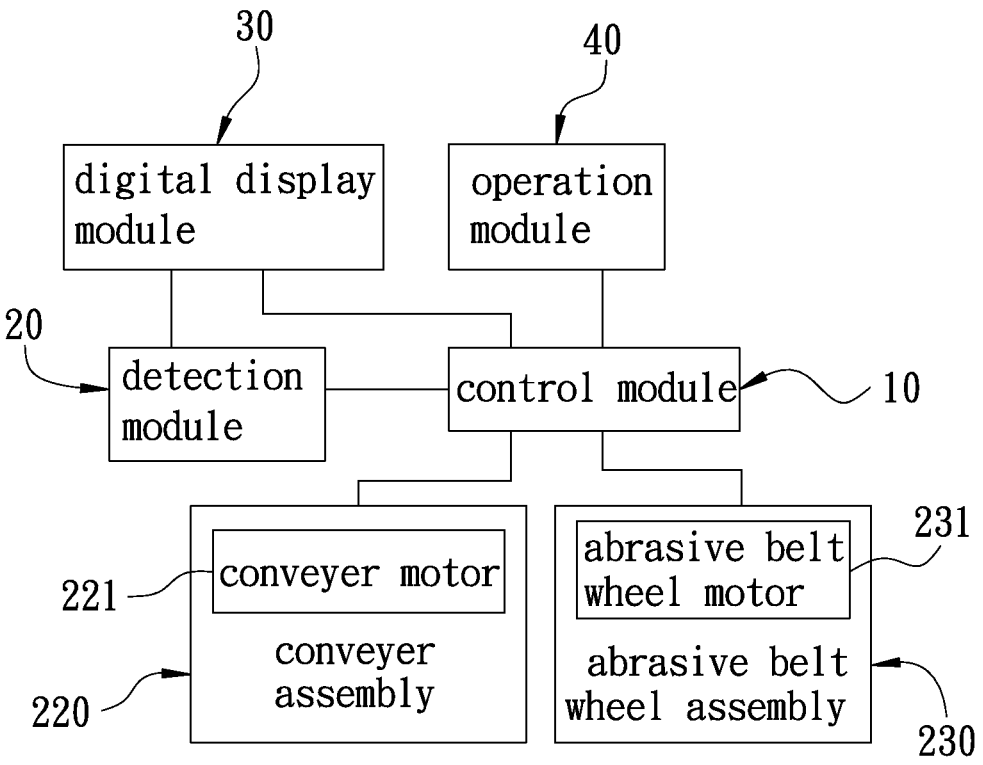
FIG. 3 is a block diagram of the present invention.

FIG. 1 is a perspective view of the present invention. FIG. 2 is an exploded view of the present invention. FIG. 3 is a block diagram of the present invention. The present invention discloses a digital panel of a belt sander. The digital panel is disposed on a belt sander 200. The belt sander 200 comprises a main body 210. The main body 210 is transversely provided with a conveyer assembly 220 and an abrasive belt wheel assembly 230. The conveyer assembly 220 comprises a conveyer motor 221. The abrasive belt wheel assembly 230 comprises an abrasive belt wheel motor 231 and an adjustment member 232. The conveyer motor 221 and the abrasive belt wheel motor 231 are electrically connected with a power source 240, respectively. The digital panel of the belt sander comprises a control module 10, a detection module 20, a digital display module 30, and an operation module 40.

Figure 4:
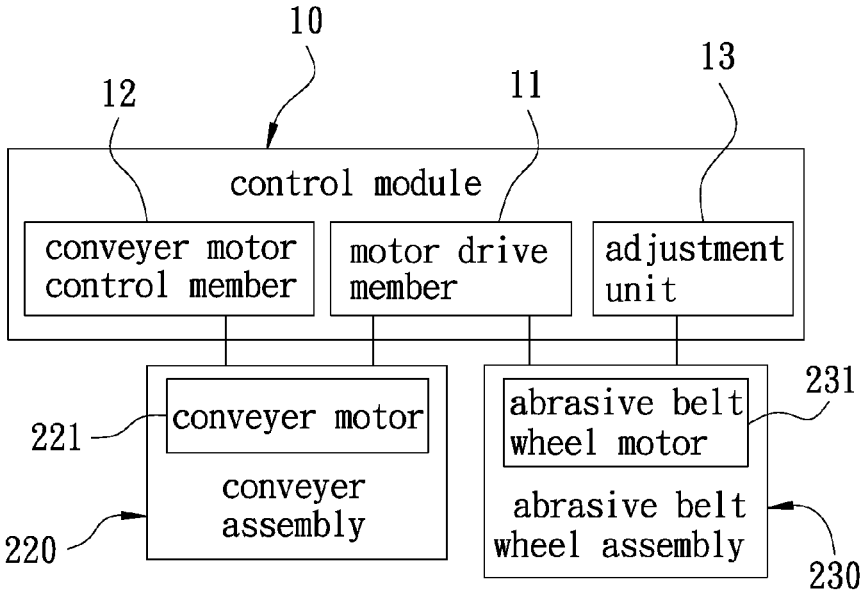
FIG. 4 is a block diagram of the control module of the present invention.

The control module 10, referring to FIG. 4, comprises a motor drive member 11, a conveyer motor control member 12, and an adjustment unit 13. The motor drive member 11 is electrically connected with the abrasive belt wheel motor 231. The conveyer motor control member 12 is electrically connected with the conveyer belt motor 221. The adjustment member 232 is longitudinally disposed on the main body 210 and coupled with the abrasive belt wheel assembly 230. The abrasive belt wheel assembly 230 can be adjusted by the adjustment member 232 to move longitudinally.

Figure 5:
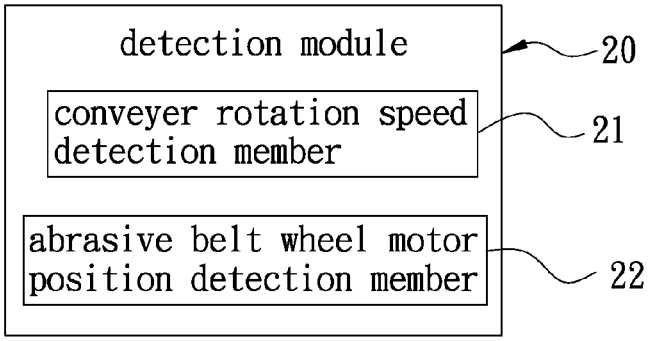
FIG. 5 is a block diagram of the detection module of the present invention.

The detection module 20, referring to FIG. 5, is electrically connected with the control module 10. The detection module 20 comprises a conveyer rotation speed detection member 21 and an abrasive belt wheel motor position detection member 22. The conveyer rotation speed detection member 21 is disposed at the position where an output shaft of the conveyer motor 221 is located. The abrasive belt wheel motor position detection member 22 is disposed at the position where the adjustment member 232 is located. Wherein, the conveyer rotation speed detection member 21 comprises a first Hall IC 211 and a first magnetic ring 212. The first Hall IC 211 is disposed on the conveyer motor 221. The first magnetic ring 212 is disposed on the rotation shaft of the conveyer motor 221. The first magnetic ring 212 has 24 poles. The abrasive belt wheel motor position detection member 22 comprises a second Hall IC 221 and a second magnetic ring 222. The second Hall IC 221 and the second magnetic ring 222 are disposed on the adjustment member 232, respectively. The second magnetic ring 222 has 40 poles.

Figure 6:
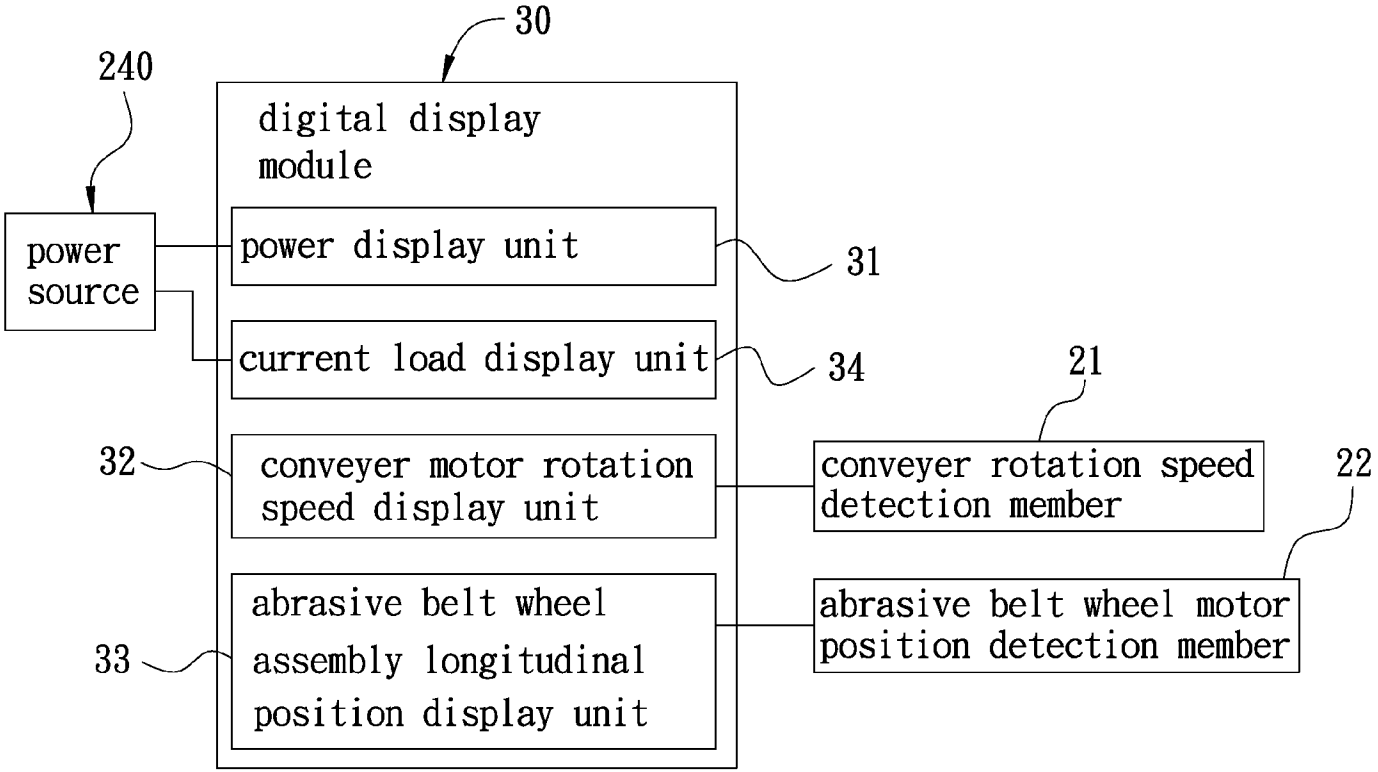
FIG. 6 is a block diagram of the digital display module of the present invention.

The digital display module 30, referring to FIG. 6, comprises a power display unit 31, a conveyer motor rotation speed display unit 32, an abrasive belt wheel assembly longitudinal position display unit 33, and a current load display unit 34. The power display unit 31 is electrically connected with the power source 240 for showing the power to be turned on/off. The conveyer motor rotation speed display unit 32 is electrically connected with the conveyer rotation speed detection member 21. The abrasive belt wheel assembly longitudinal position display unit 33 is electrically connected with the abrasive belt wheel motor position detection member 22. The current load display unit 34 is electrically connected with the power source 240.

Figure 7:
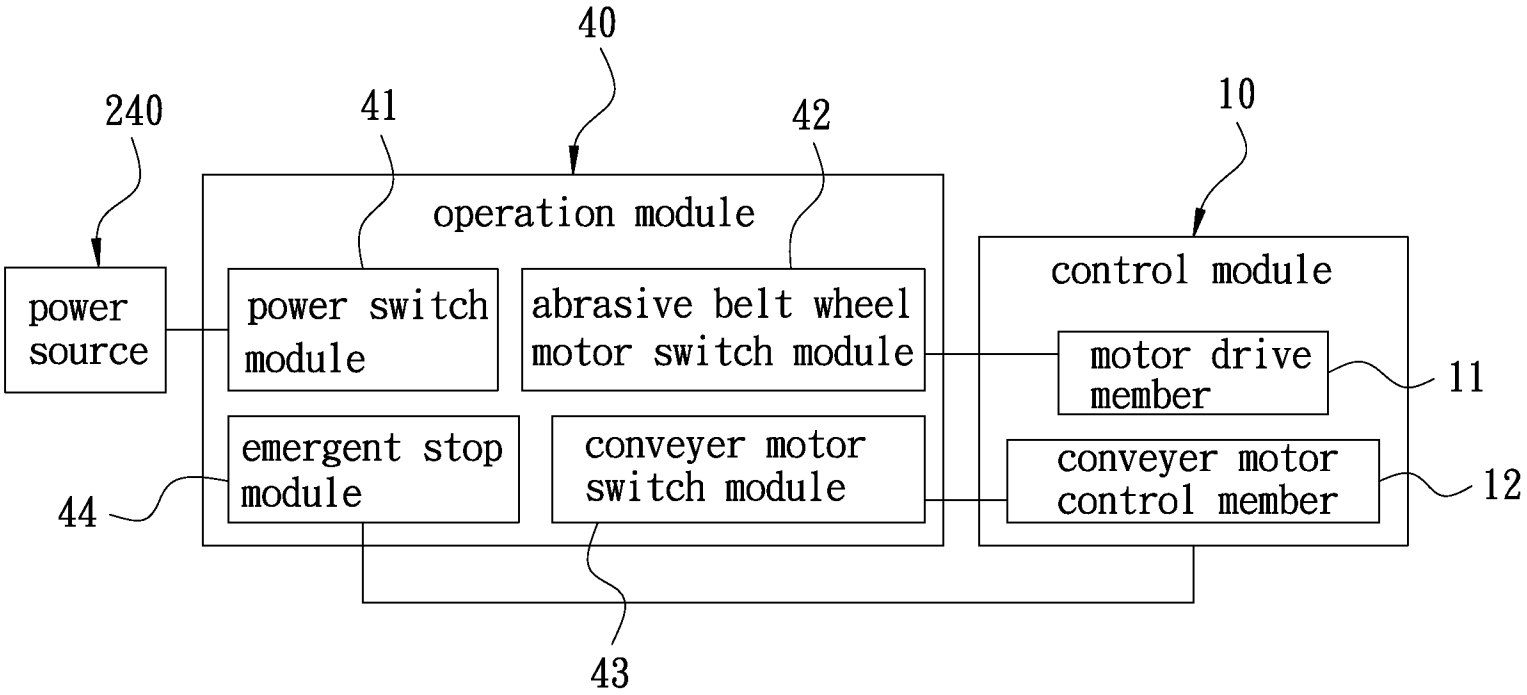
FIG. 7 is a block diagram of the operation module of the present invention.

The operation module 40, referring to FIG. 7, comprises a power switch module 41, an abrasive belt wheel motor switch module 42, a conveyer motor switch module 43, and an emergent stop module 44. The power switch module 41 is electrically connected with the power source 240. The abrasive belt wheel motor switch module 42 is electrically connected with the abrasive belt wheel motor 231. The conveyer motor switch module 43 is electrically connected with the conveyer motor 221. The emergent stop module 44 is electrically connected with the control module 10. The emergent stop module 44 can generate a closed signal to stop activation of the control module 10. When the abrasive belt wheel motor switch module 42 and the conveyer motor switch module 43 are switched off, the closed signal of the emergent stop module 44 is stopped. When the abrasive belt wheel motor switch module 42 and the conveyer motor switch module 43 are switched on again, the control module 10 is activated again.

Referring to FIG. 1 to FIG. 3, the power of the belt sander is turned on through the power switch module 41 of the operation module 40. At this moment, the belt sander is in an initial state, the abrasive belt wheel assembly 230 is located at an initial position. The abrasive belt wheel assembly longitudinal position display unit 33 of the digital display module 30 displays zero, corresponding to the longitudinal position of the abrasive belt wheel assembly 230. When the abrasive belt wheel motor position detection member 22 detects that the abrasive belt wheel assembly 230 is adjusted by the adjustment member 232 to move longitudinally, the abrasive belt wheel assembly longitudinal position display unit 33 of the digital display module 30 displays the relative value, corresponding to the longitudinal position of the abrasive belt wheel assembly 230.

When the abrasive belt wheel motor switch module 42 of the operation module 40 is switched on, the abrasive belt wheel motor 231 of the abrasive belt wheel assembly 230 is driven by the motor drive member 11 of the control module 10 and the digital display module 30 displays that the abrasive belt wheel motor 231 is activated. At this moment, the abrasive belt wheel motor 231 is in an idle state. The current load display unit 34 of the digital display module 30 displays the relative equalization instruction, corresponding to the idle state of the abrasive belt wheel motor 231.

When the conveyer motor switch module 43 of the operation module 40 is switched on, the conveyer motor 221 of the conveyer assembly 220 is driven by the conveyer motor control member 12 of the control module 10 and the digital display module 30 displays that the conveyer motor 221 is activated. At this moment, the conveyer rotation speed detection member 21 detects the rotation speed of the conveyer motor 221. The conveyer motor rotation speed display unit 32 of the digital display module 30 displays the relative data of the rotation speed, corresponding to the rotation speed of the conveyer motor 221.

When the workpiece is placed on the conveyer assembly 220 to be polished by the abrasive belt wheel assembly 230, the abrasive belt wheel motor 231 will increase load because of driving the abrasive belt wheel assembly 230 to polish the workpiece. At this moment, the current flow of the abrasive belt wheel motor 231 will increase accordingly. The current load display unit 34 of the digital display module 30 displays the relative equalization instruction, corresponding to the load state of the abrasive belt wheel motor 231. When the current of the abrasive belt wheel motor 231 overloads, the current load display unit 34 of the digital display module 30 will immediately display a warning equalization instruction, and the rotation speed of the conveyer motor 221 is lowered by the conveyer motor control member 12 of the control module 10. In the meanwhile, the conveyer motor rotation speed display unit 32 of the digital display module 30 displays the relative data, corresponding to the rotation speed of the conveyer motor 221.

It is noted that when the user presses the emergency stop module 44 of the operation module 40, a closed signal is generated to turn off the power source of the belt sander so as to stop all operations. When it is necessary to restart the power, the abrasive belt wheel motor switch module 42 and the conveyer motor switch module 43 which are still in the "on" position must be switched to the "off" position first, and then the abrasive belt wheel motor 231 and the conveyer motor 221 are restarted through the abrasive belt wheel motor switch module 42 and the conveyer motor switch module 43.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A digital panel of a belt sander, the digital panel being disposed on the belt sander, the belt sander comprising a main body, the main body being transversely provided with a conveyer assembly and an abrasive belt wheel assembly, the conveyer assembly comprising a conveyer motor, the abrasive belt wheel assembly comprising an abrasive belt wheel motor and an adjustment member, the conveyer motor and the abrasive belt wheel motor being electrically connected with a power source respectively, the digital panel of the belt sander comprising:

a control module, the control module comprising a motor drive member, a conveyer motor control member, and an adjustment unit, the motor drive member being electrically connected with the conveyer motor and the abrasive belt wheel motor respectively, the conveyer motor control member being electrically connected with the conveyer belt motor, the adjustment member being longitudinally disposed on the main body and coupled with the abrasive belt wheel assembly, the abrasive belt wheel assembly being adjustable by the adjustment member to move longitudinally;

a detection module, the detection module being electrically connected with the control module, the detection module comprising a conveyer rotation speed detection member and an abrasive belt wheel motor position detection member, the conveyer rotation speed detection member is disposed at the position where an output shaft of the conveyer motor is located, the abrasive belt wheel motor position detection member being disposed at the position where the adjustment member is located;

a digital display module, the digital display module comprising a power display unit, a conveyer motor rotation speed display unit, an abrasive belt wheel assembly longitudinal position display unit, and a current load display unit, the power display unit being electrically connected with the power source for showing the power to be turned on/off, the conveyer motor rotation speed display unit being electrically connected with the conveyer rotation speed detection member, the abrasive belt wheel assembly longitudinal position display unit being electrically connected with the abrasive belt wheel motor position detection member, the current load display unit being electrically connected with the power source; and an operation module, the operation module comprising a power switch module, an abrasive belt wheel motor switch module, a conveyer motor switch module, and an emergent stop module, the power switch module being electrically connected with the power source, the abrasive belt wheel motor switch module being electrically connected with the abrasive belt wheel motor, the conveyer motor switch module being electrically connected with the conveyer motor, the emergent stop module being electrically connected with the control module;

thereby, the operation module controlling the conveyer motor and the abrasive belt wheel motor of the belt sander and displaying running data of the conveyer motor and the abrasive belt wheel motor for the belt sander to be digitalized.

2. The digital panel of a belt sander as claimed in claim 1, wherein the conveyer rotation speed detection member comprises a first Hall IC and a first magnetic ring, the first Hall IC is disposed on the conveyer motor, and the first magnetic ring is disposed on a rotation shaft of the conveyer motor.

3. The digital panel of a belt sander as claimed in claim 2, wherein the first magnetic ring has 24 poles.

4. The digital panel of a belt sander as claimed in claim 1, wherein the abrasive belt wheel motor position detection member comprises a second Hall IC and a second magnetic ring, the second Hall IC is disposed on the abrasive belt wheel motor, and the second magnetic ring is disposed on the adjustment member.

5. The digital panel of a belt sander as claimed in claim 4, wherein the second magnetic ring 222 has 40 poles.

6. The digital panel of a belt sander as claimed in claim 1, wherein the emergent stop module is able to generate a closed signal to stop activation of the control module, when the power switch module is switched off, the closed signal of the emergent stop module is stopped, when the power switch module is switched on again, the control module is activated again.

* * * * *